US011655121B2

(12) United States Patent
Fever et al.

(10) Patent No.: US 11,655,121 B2
(45) Date of Patent: May 23, 2023

(54) ELEVATOR CAR

(71) Applicant: Otis Elevator Company, Farmington, CT (US)

(72) Inventors: Michael Fever, Ouzouer sur Loire (FR); Nawel Bettaieb, Sully-sur-Loire (FR); Alper Caliskan, Loiret/Centre (FR); Herve Senejoux, Gien (FR)

(73) Assignee: OTIS ELEVATOR COMPANY, Farmington, CT (US)

( * ) Notice: Subject to any disclaimer, the term of this patent is extended or adjusted under 35 U.S.C. 154(b) by 256 days.

(21) Appl. No.: 17/091,932

(22) Filed: Nov. 6, 2020

(65) Prior Publication Data

US 2021/0139284 A1 May 13, 2021

(30) Foreign Application Priority Data

Nov. 8, 2019 (EP) ..... 19306444

(51) Int. Cl.

| | |
|---|---|
| ***B66B 11/02*** | (2006.01) |
| *E06C 1/393* | (2006.01) |
| *E06C 7/50* | (2006.01) |

(52) U.S. Cl.

CPC ..... *B66B 11/0246* (2013.01); *E06C 1/393* (2013.01); *E06C 7/50* (2013.01)

(58) Field of Classification Search

CPC . B66B 11/0246; B66B 11/0226; B66B 5/005; B66B 5/0087; E06C 1/393; E06C 7/50

See application file for complete search history.

(56) References Cited

U.S. PATENT DOCUMENTS 4,043,430 A * 8/1977 Kraft ..... B66B 13/08 187/324
6,691,833 B1 * 2/2004 Elsener ..... B66B 11/0246 187/254

(Continued)

FOREIGN PATENT DOCUMENTS

| | | | |
|---|---|---|---|
| EP | 3560877 A1 | 10/2019 | |
| FR | 2841885 A1 * | 1/2004 | ..... B66B 11/0246 |
| WO | 2018104578 A1 | 6/2018 | |

OTHER PUBLICATIONS

European Search Report for Application No. 19306444.1; dated May 14, 2020; 8 Pages.

*Primary Examiner* — Michael A Riegelman
(74) *Attorney, Agent, or Firm* — Cantor Colburn LLP

(57) ABSTRACT

An elevator car includes a car floor; a movable ceiling, which is pivotable between a normal operating position, in which the movable ceiling extends substantially horizontally and a maintenance position, in which the movable ceiling extends into an interior space of the elevator car; a working platform movably attached to the movable ceiling. The working platform is pivotable between a storage position, in which the working platform extends basically parallel to the movable ceiling, and a working position, in which the working platform extends transversely from the movable ceiling; and at least one foldable leg attached to the working platform. The at least one foldable leg is foldable between a storage configuration, in which the at least one foldable leg extends substantially parallel to the working platform, and a working configuration, in which the at least one foldable leg extends transversely from the working platform for supporting the working platform.

14 Claims, 16 Drawing Sheets

(56) References Cited

U.S. PATENT DOCUMENTS

| | | | | |
|---|---|---|---|---|
| 6,880,678 | B1 * | 4/2005 | Schneider | B66B 11/0246 187/314 |
| 9,193,566 | B1 * | 11/2015 | Nieves | B66B 11/0226 |
| 9,546,078 | B2 * | 1/2017 | Paasisalo | B66B 13/24 |
| 11,091,352 | B2 * | 8/2021 | Fauconnet | B66B 11/0246 |
| 11,104,550 | B2 * | 8/2021 | Fernandez | B66B 11/0246 |
| 11,427,441 | B2 * | 8/2022 | Fauconnet | B66B 9/00 |
| 2007/0056810 | A1 * | 3/2007 | Fernandes | B66B 11/0246 187/401 |
| 2016/0325964 | A1 * | 11/2016 | Haapaniemi | B66B 5/0062 |
| 2019/0119073 | A1 * | 4/2019 | Haapaniemi | B66B 11/0246 |
| 2019/0263629 | A1 * | 8/2019 | Fernandez | B66B 11/0246 |
| 2019/0330024 | A1 * | 10/2019 | Durand | B66B 11/0226 |
| 2019/0389698 | A1 * | 12/2019 | Jimenez-Gonzalez | B66B 11/0246 |
| 2021/0061616 | A1 * | 3/2021 | Fauconnet | B66B 9/00 |
| 2021/0139284 | A1 * | 5/2021 | Fever | B66B 11/0246 |
| 2021/0155458 | A1 * | 5/2021 | Montigny | B66B 11/0246 |
| 2021/0269279 | A1 * | 9/2021 | Talonen | B66B 1/30 |
| 2021/0269283 | A1 * | 9/2021 | Siironen | B66B 11/0246 |
| 2021/0354955 | A1 * | 11/2021 | Haapaniemi | B66B 5/0081 |
| 2022/0024724 | A1 * | 1/2022 | Fauconnet | B66B 9/00 |

* cited by examiner

ELEVATOR CAR

FOREIGN PRIORITY

This application claims priority to European Patent Application No. 19306444.1, filed Nov. 8, 2019, and all the benefits accruing therefrom under 35 U.S.C. § 119, the contents of which in its entirety are herein incorporated by reference.

TECHNICAL FIELD OF INVENTION

The invention relates to an elevator car with a movable working platform, to a method of deploying such a working platform, and to an elevator system comprising such an elevator car.

BACKGROUND OF THE INVENTION

An elevator system comprises at least one elevator car traveling along a hoistway between a plurality of landings. For repair and/or maintenance purposes, it may be necessary for a mechanic to access an area on top or above the elevator car.

It therefore is desirable to provide an elevator car which allows a mechanic to safely and conveniently access an area on top or above the elevator car.

SUMMARY OF THE INVENTION

According to an exemplary embodiment of the invention, an elevator car comprises: a floor; a movable ceiling, which is pivotable between a normal operating position, in which the movable ceiling extends substantially horizontally (parallel to the floor), and a maintenance position, in which the movable ceiling extends into an interior space of the elevator car; a working platform movably attached to the movable ceiling, wherein the working platform is pivotable between a storage position, in which the working platform extends basically parallel to the movable ceiling, and a working position, in which the working platform extends transversely from the movable ceiling; and at least one foldable leg attached to the working platform, wherein the at least one foldable leg is foldable between a storage configuration, in which the at least one foldable leg extends substantially parallel to the working platform, and a working configuration, in which the at least one foldable leg extends transversely from the working platform for supporting the working platform on the floor.

Exemplary embodiments of the invention also include a method of deploying a working platform of an elevator car comprising the movable working platform according to an exemplary embodiment of the invention. According to an exemplary embodiment of the invention, the method includes unlocking the movable ceiling; moving the movable ceiling from its normal operating position into its maintenance position; moving the working platform from its storage position into its working position; extending the at least one foldable leg from its storage configuration into its working configuration before, while and/or after the working platform is moved; locking the at least one foldable leg in its working configuration; and supporting the at least one foldable leg on the floor of the elevator car.

Exemplary embodiments of the invention further include an elevator system comprising at least one elevator car according to an exemplary embodiment of the invention.

In an elevator car according to an exemplary embodiment of the invention, the working platform is movable between a storage position and a working position. When arranged in the storage position, the working platform is arranged at the top of the elevator car, in particular on top of an interior space of the elevator car, so that it does not reduce the space which is available to passengers. Due to the at least one foldable leg, the working platform may be employed and stored even in a relatively small elevator car.

When arranged in the working position, the working platform is firmly supported on the ground allowing mechanics to safely step onto the working platform for performing repair and/or maintenance work, in particular in an area on top or above the elevator car. As the working platform, when arranged in the working position, is supported on the floor the elevator system, no additional weight is put on the movable ceiling. The movable ceiling therefore does not need to be enforced for supporting such additional weight.

A number of optional features are set out in the following. These features may be realized in particular embodiments, alone or in combination with any of the other features, unless specified otherwise.

When arranged in the maintenance position, the movable ceiling may extend substantially vertically into an interior space of the elevator car parallel to the side walls of the elevator car. Such an orientation results in a space saving configuration of the movable ceiling when it is arranged in the maintenance position.

When arranged in the working position, the working platform may extend substantially orthogonally from the movable ceiling; it in particular may extend substantially horizontally and parallel to the floor of the elevator car. A substantially horizontally extending working platform provides a safe and convenient working ground for a mechanic.

The at least one foldable leg may comprise at least two leg portions, which are pivotably linked with each other. A foldable leg comprising at least two leg portions pivotably linked with each other may be space savingly stored in a folded state by pivoting the at least two leg portions with respect to each other. Depending on the dimensions of the elevator car, the at least one foldable leg may comprise more than two linked leg portions.

The at least one foldable leg may be lockable in at least one of the storage configuration and the working configuration. Similarly, the movable ceiling may be lockable in at least one of the normal operating position and the maintenance position. Locking the at least one foldable leg and/or the movable ceiling prevents an undesired, accidental movement of the at least one foldable leg and/or the movable ceiling, thereby enhancing the operational safety of the elevator car. Locking the movable ceiling in its normal operating position in particular prevents the movable ceiling from accidentally dropping into the interior space of the elevator car.

The elevator car may comprise at least two foldable legs. The at least two foldable legs in particular may be mounted to opposing ends, in particular to a front end and a rear end, of the working platform for providing a well-balanced support of the working platform.

The at least one foldable leg may comprise at least one step, in particular a plurality of steps forming a ladder extending between the floor of the elevator car and the working platform when the working platform is arranged in its working position. Providing one or more steps makes it easier and safer for mechanics to climb onto and from the working platform.

In order to provide easy access to the working platform, the at least one step in particular may be formed in a foldable leg which is mounted to a portion of the working platform facing an elevator car door when arranged in the working position.

The elevator car may comprise at least one mechanical link configured for mechanically linking the working platform with the movable ceiling. The at least one mechanical link may allow the working platform to pivot with respect to the movable ceiling in order to move the working platform between the storage position and the working position.

The at least one mechanical link may further be configured for allowing the working platform to move linearly with respect to the movable ceiling, in particular in a substantially vertical direction, in order to allow positioning a lower end of the at least one foldable leg onto the floor over the elevator car after the at least one foldable leg has been extended into its working configuration.

The at least one mechanical link may comprise a support bar attached to and/or formed integrally with the working platform. The at least one mechanical link may further comprise at least one curved, in particular concave, support surface attached to and/or formed integrally with the movable ceiling and supporting the support bar. Rotation of the support bar around a horizontal axis allows the working platform to pivot with respect to the movable ceiling. Lifting the support bar from the support surface allows for a linear motion of the working platform with respect to the movable ceiling.

In order to allow for a smooth pivoting motion of the working platform, the support bar may have a round cross-section, in particular a circular cross-section or an elliptical cross-section, resulting in a round, in particular cylindrical, outer peripheral surface of the support bar.

The at least one mechanical link may further comprise a mechanical barrier preventing the working platform from being separated from the movable ceiling. The at least one mechanical barrier may be arranged in some distance above the support surface limiting the maximum vertical distance between the support bar and the support surface when the support bar is lifted from the support surface and preventing the support bar from being completely separated from the support surface.

The elevator car may further comprise at least one sensor which is configured for detecting whether the movable ceiling is arranged in its normal operating position. An output signal provided by the at least one sensor may be supplied to an elevator controller preventing any movement of the elevator car when the movable ceiling is not arranged in its normal operating position. This enhances the operational safety of the elevator system.

In a further configuration, the elevator car may be allowed to move in a restricted maintenance mode, when the movable ceiling is not arranged in its normal operating position. When the elevator system is operated in the restricted maintenance mode, the positions, the speed and/or the acceleration of the elevator car may be restricted compared to a normal mode of operation.

BRIEF DESCRIPTION OF THE DRAWINGS

Further exemplary embodiments of the invention will be described with respect to the accompanying drawings, wherein.

DETAILED DESCRIPTION

Figure 1:
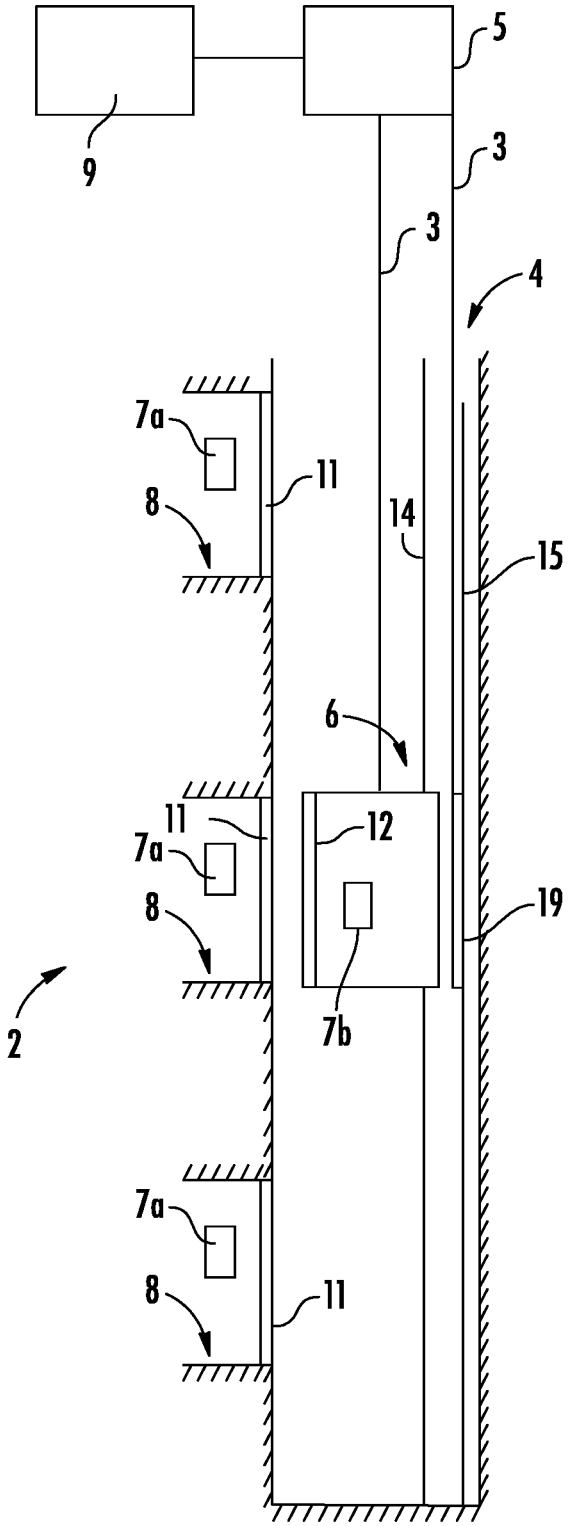
FIG. 1 schematically depicts an elevator system comprising an elevator car according to an exemplary embodiment of the invention.

FIG. 1 schematically depicts an elevator system 2 according to an exemplary embodiment of the invention.

The elevator system 2 includes an elevator car 6 movably arranged within a hoistway 4 extending between a plurality of landings 8. The elevator car 6 in particular is movable in a longitudinal (vertical) direction along a plurality of car guide members 14, such as guide rails, extending along the vertical direction of the hoistway 4. On-ly one of said car guide members 14 is depicted in FIG. 1.

Although only one elevator car 6 is shown in FIG. 1, the skilled person understands that exemplary embodiments of the invention may include elevator systems 2 including a plurality of elevator cars 6 moving in one or more hoistways 4.

The elevator car 6 is movably suspended by means of a driving member (tension member) 3. The driving member 3, for example a rope or belt, is connected to a drive unit 5, which is configured for driving the driving member 3 in order to move the elevator car 6 along the height of the hoistway 4 between the plurality of landings 8, which are located on different floors.

Details of the roping configuration are not specified in FIG. 1. The skilled person understands that the type of the roping is not essential for the invention and that dif-ferent kinds of roping, such as a 1:1 roping, a 2:1 roping or a 4:1 roping may be employed.

The driving member 3 may be a rope, e.g. a steel wire rope, or a belt. The driving member 3 may be uncoated or may have a coating, e.g. in the form of a polymer jacket. In a particular embodiment, the driving member 3 may be a belt comprising a plurality of polymer coated steel cords (not shown). The elevator system 2 may have a traction drive including a traction sheave for driving the driving member 3. In an alternative configuration, which is not shown in the figures, the elevator system 2 may be an elevator system 2 without a driving member 3.

The elevator system 2 also may comprise e.g. a hydraulic drive or a linear drive. The elevator system 2 may have a machine room (not shown) or it may be a machine room-less elevator system 2.

The elevator system 2 further includes a counterweight 19 attached to the driving member 3 and configured for moving concurrently and in opposite direction with respect to the elevator car 6 along at least one counterweight guide member 15. The skilled person will understand that the invention may be applied also to elevator systems 2 which do not comprise a counterweight 19.

Each landing 8 is provided with a landing door 11, and the elevator car 6 is provided with a corresponding elevator car door 12 for allowing passengers to transfer be-tween a landing 8 and the elevator car 6 when the elevator car 6 is positioned at the respective landing 8.

The drive unit 5 is controlled by an elevator controller 9 for moving the elevator car 6 along the hoistway 4 between the different landings 8.

Input to the elevator controller 9 may be provided via landing control panels 7*a*, which are provided on each landing 8 close to the landing doors 11, and/or via an elevator car control panel 7*b*, which is provided inside the elevator car 6.

The landing control panels 7*a* and the elevator car control panel 7*b* may be connected to the elevator controller 9 by means of electric wires, which are not shown in FIG. 1, in particular by an electric bus, or by means of wireless data connections.

FIGS. 2 to 13 depict schematic cross-sectional side views of an elevator car according to an exemplary embodiment of the invention.

The elevator car 6 comprises a horizontally extending car floor 20, a ceiling frame 22 comprising a plurality of ceiling frame bars 22*a*-22*d* extending in some distance from and parallel to the car floor 20, and side walls 23*a*-23*d* extending between the ceiling frame 22 and the car floor 20 defining an interior space 21 of the elevator car 6.

Only two ceiling frame bars 22*a*, 22*b* and two side walls 23*a*, 23*b*, in particular a rear wall 23*a* and a front wall 23*b*, of the elevator car 6 are visible in the side views depicted in FIGS. 2 to 13. Two further ceiling frame bars 22*c*, 22*d*, and two further side walls 23*c*, 23*d*, i.e. a left side wall 23*c* and a right side wall 23*d*, are visible in the front view of the elevator car 6 depicted in FIG. 14, which will be discussed in more detail further below.

At least one elevator car door 12 is provided in at least one of the side walls 23*a*-23*d*. In the elevator car 6 depicted FIGS. 2 to 14, an elevator car door 12 is provided in the front wall 23*b*, which is depicted on the right side of FIGS. 2 to 13.

A movable ceiling 24, which may be a decorative ceiling 24, is movably attached to the ceiling frame 22. The movable ceiling 24 in particular is pivotably linked with the ceiling frame 22 by at least one ceiling hinge 30, which allows the movable ceiling 24 to pivot around a horizontally extending axis A between a normal operating position (see FIG. 2), and a maintenance position (see FIGS. 3 to 14).

During normal operation of the elevator system 2, i.e. when the elevator car 6 is used for transporting passengers between the different landings 8, the movable ceiling 24 is arranged in the normal operating position (see FIG. 2), in which it ex-tends substantially horizontally parallel to the ceiling frame 22 and the car floor 20.

The elevator car 6 further comprises a locking mechanism 32, which is arranged at the ceiling frame 22 and/or at the movable ceiling 24. The locking mechanism 32 allows locking the movable ceiling 24 when it is arranged in the normal operating position in order to prevent the movable ceiling 24 from accidentally dropping into the interior space 21.

For preventing an unauthorized movement of the movable ceiling 24, a special tool or key, which is available only to authorized mechanics, may be necessary for unlocking the locking mechanism 32. The locking mechanism 32 may be connected with the elevator controller 9 in order to allow unlocking the locking mechanism 32 only after the elevator car 6 has been stopped and/or in order to prevent any movement of the elevator car 6 while the locking mechanism 32 in unlocked.

Figure 2:
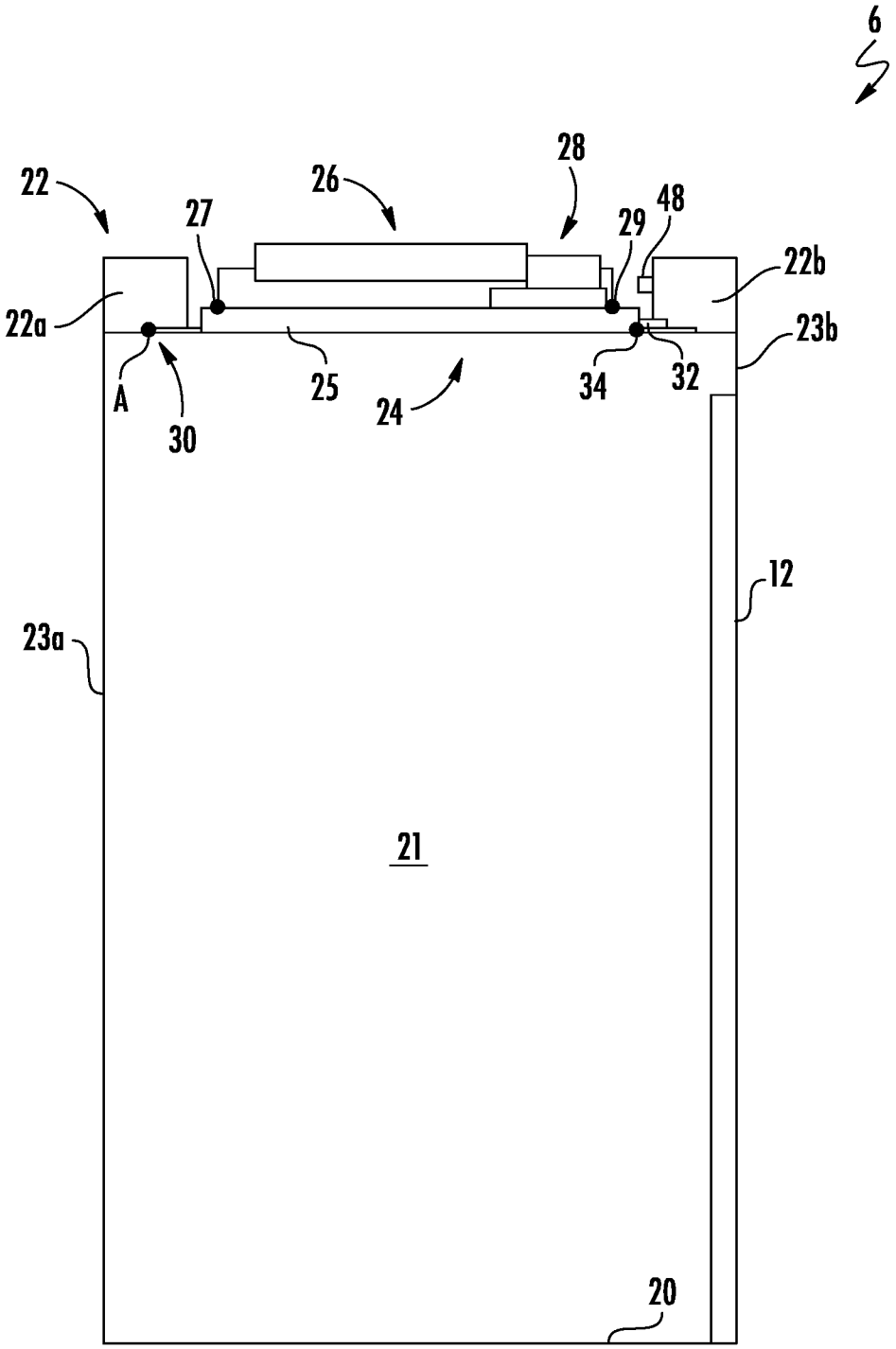
FIGS. 2 to 13 schematically depict cross-sectional side views of an elevator car according to an exemplary embodiment of the invention within the working platform arranged in different positions.
Figure 3:
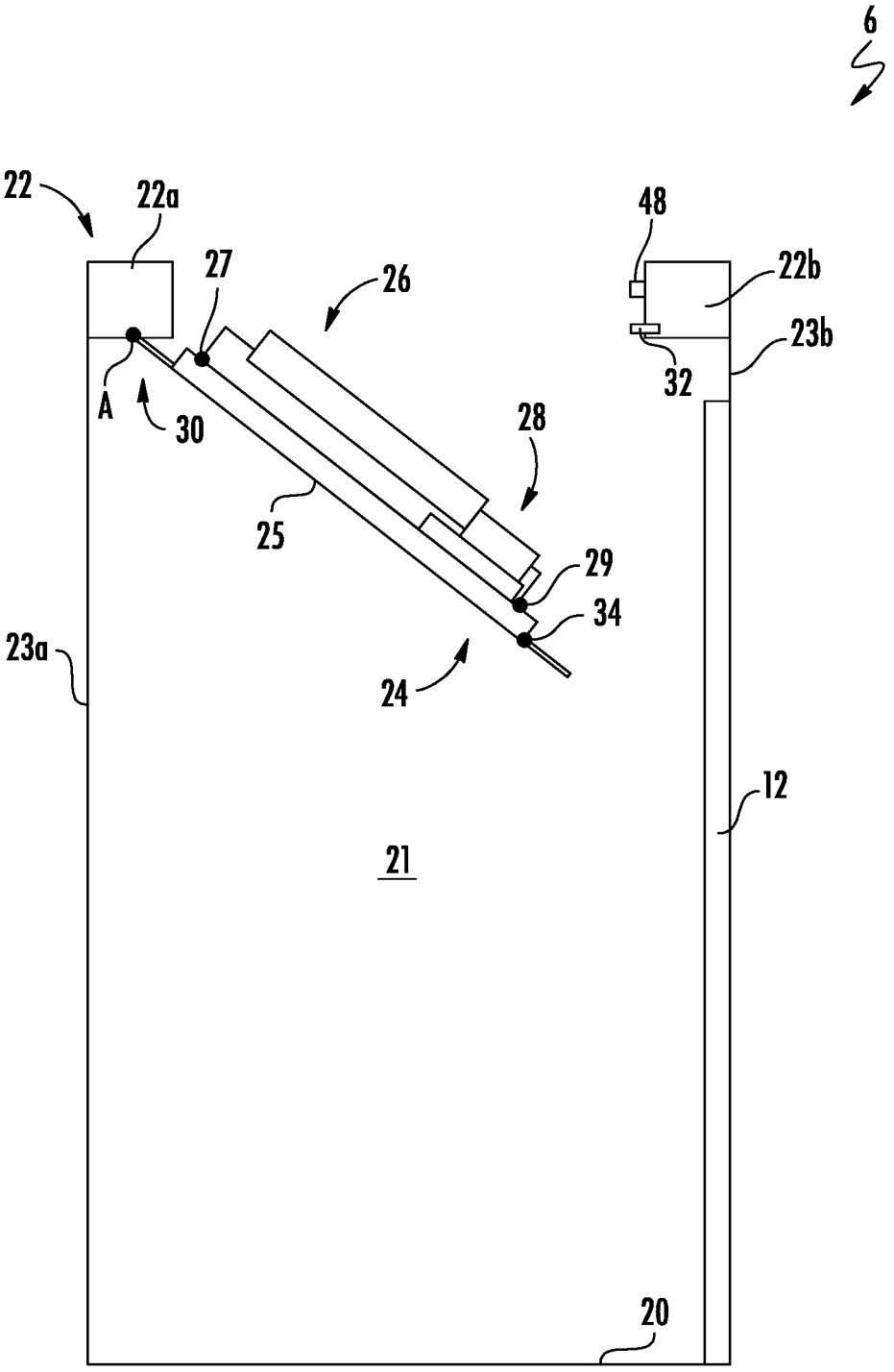

On the side facing away from the interior of the elevator car 6, i.e. on the upper side in FIG. 2, a working platform 25 is attached to the movable ceiling 24. The working platform 25 is attached to the movable ceiling 24 via a mechanical link 34. The mechanical link 34 allows the working platform 25 to move with respect to the movable ceiling 24. The functionality and details of the structure of the mechanical link 34 will be discussed further below.

In the configuration depicted in FIG. 2, the working platform 25 is arranged in a storage position, in which it extends parallel to the decorative ceiling 24.

Two foldable legs 26, 28 are pivotably attached to the working platform 25 by respective external leg hinges 27, 29. In the configuration depicted in FIG. 2, the foldable legs 26, 28 are arranged in their respective storage configurations extending substantially parallel to the working platform 25 in a folded configuration.

Figure 4:
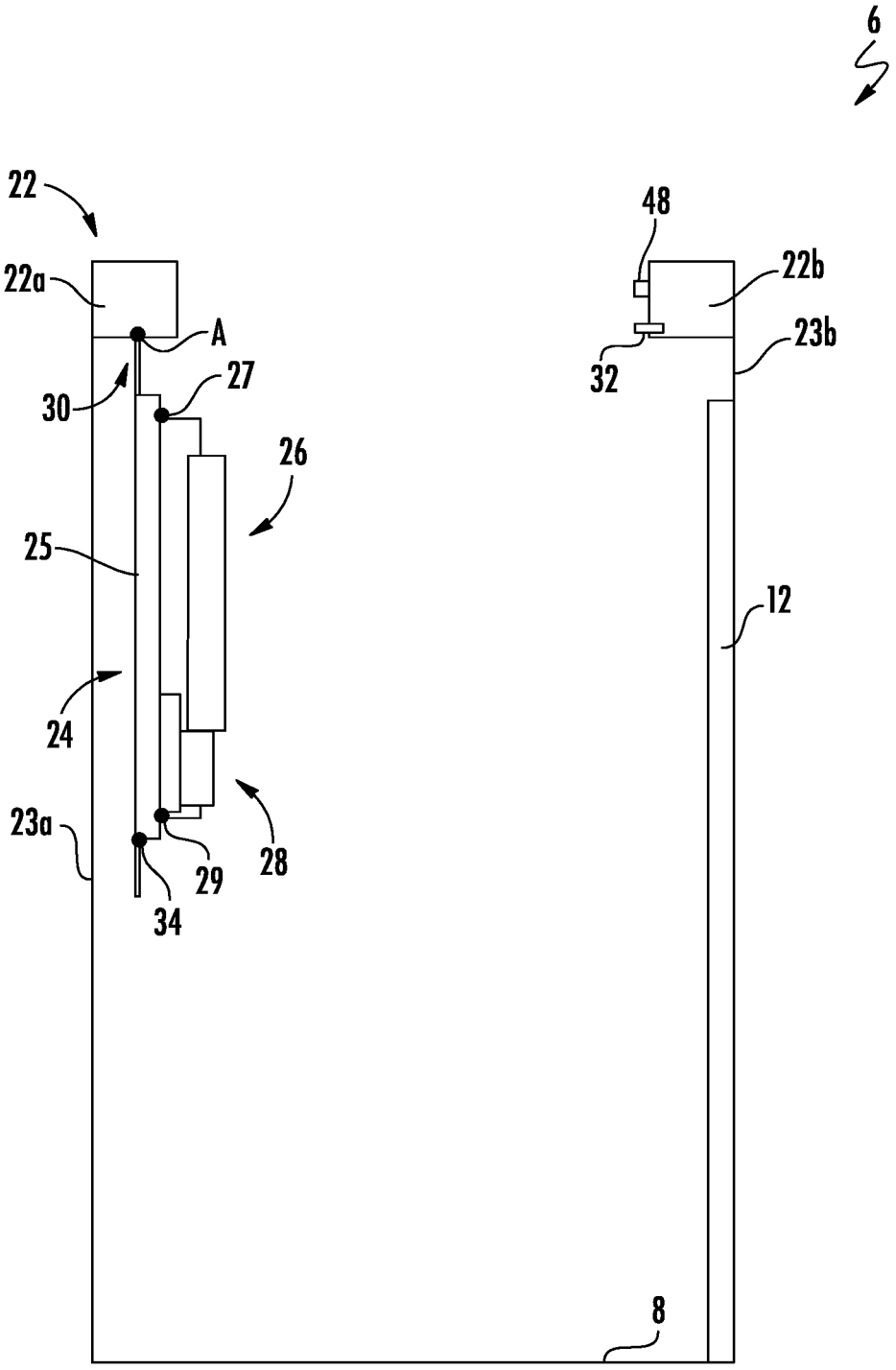

In order to deploy the working platform 25 from its normal operating position, the locking mechanism 32 is unlocked, and the movable ceiling 24 is pivoted together with the working platform 25 and the two foldable legs 26, 28 around the horizontal axis A into the interior space 21 of the elevator car 6 (cf. FIGS. 2 to 4) until it reaches the maintenance position depicted in FIG. 4. When arranged in the maintenance position, the movable ceiling 24 extends in a substantially vertical orientation basically parallel to the side walls 23*a*-23*d* of the elevator car 6.

Figure 5:
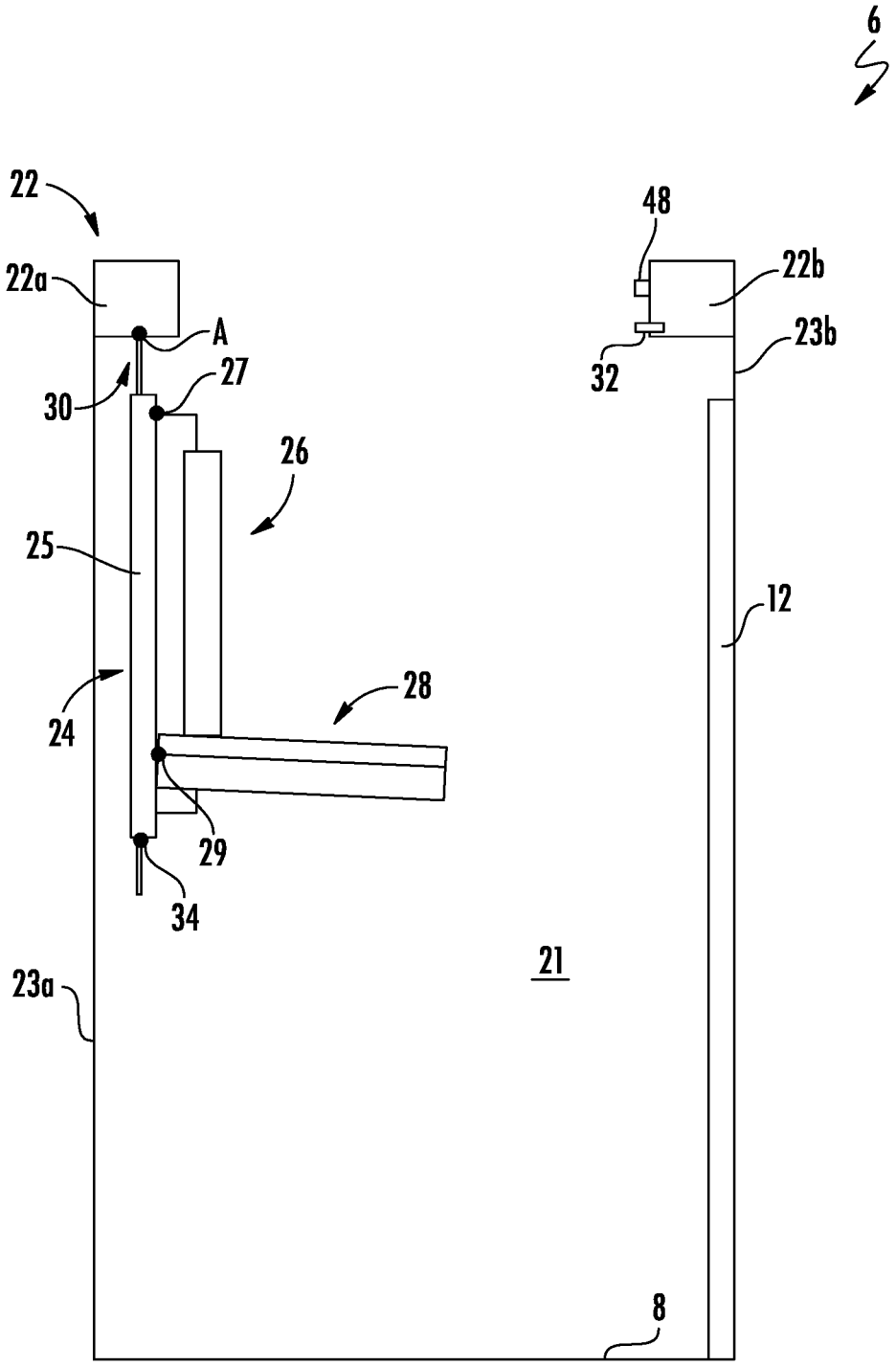

After the movable ceiling 24 has been moved into the maintenance position, at least one of the foldable legs 26, 28, in particular a rear leg 28, which is mounted to the working platform 25 at a position next to the mechanical link 34 connecting the working platform 25 to the movable ceiling 24, is moved from its storage configuration, in which it extends basically parallel to the working platform 25, into an at least partially extended configuration, in which it extends transversely from the working platform 25 (see FIG. 5).

Figure 6:
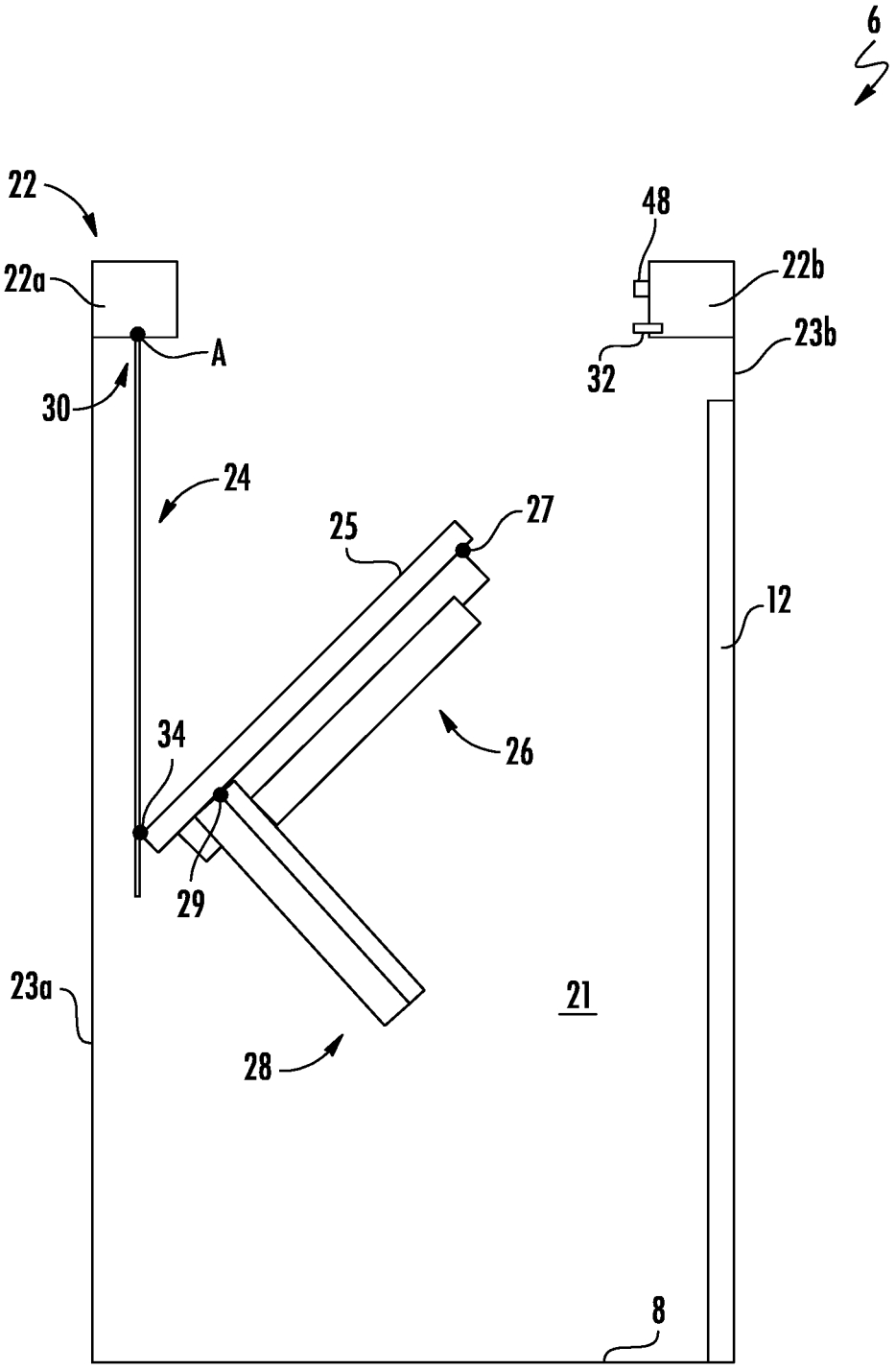
Figure 7:
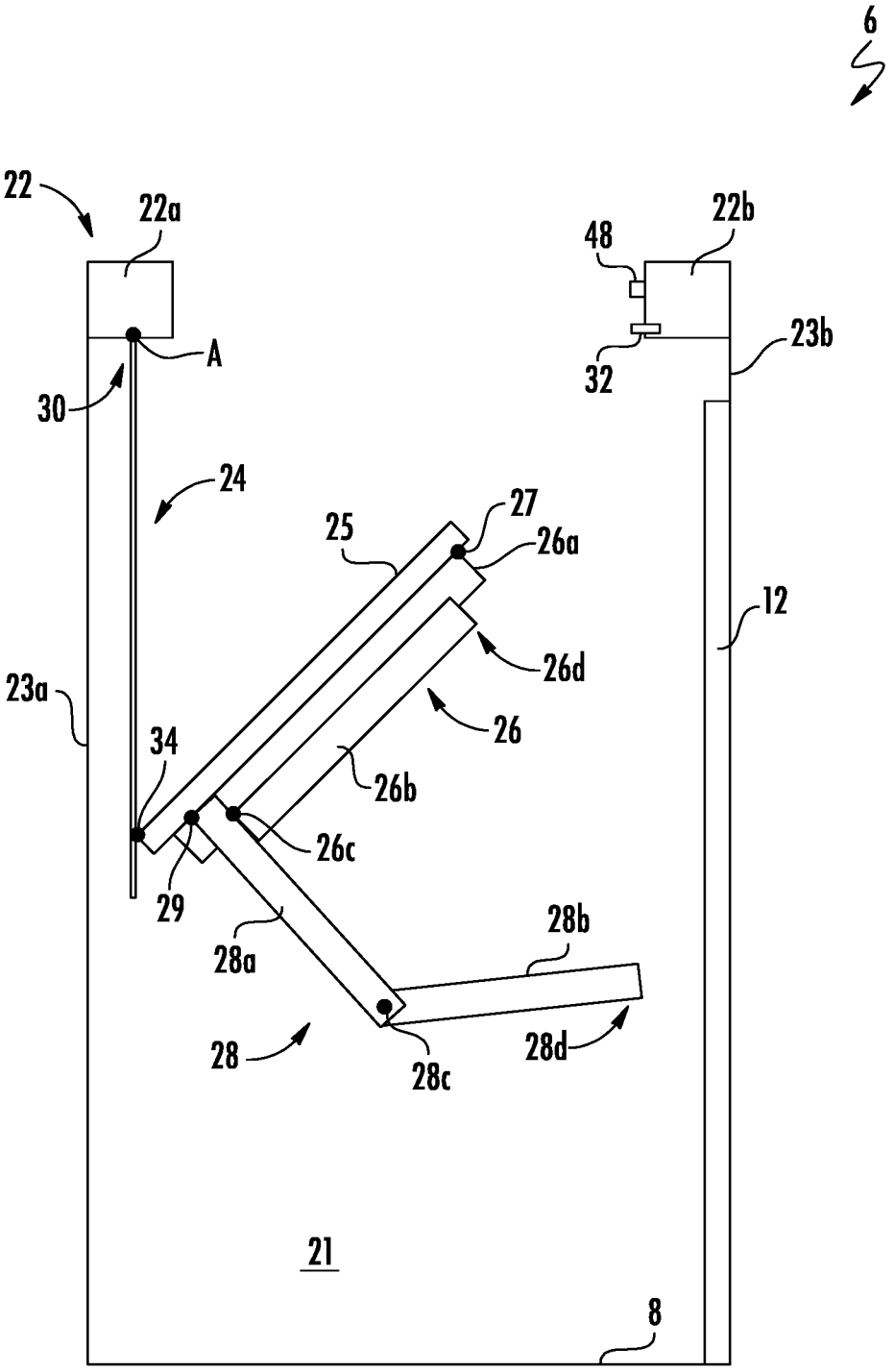
Figure 8:
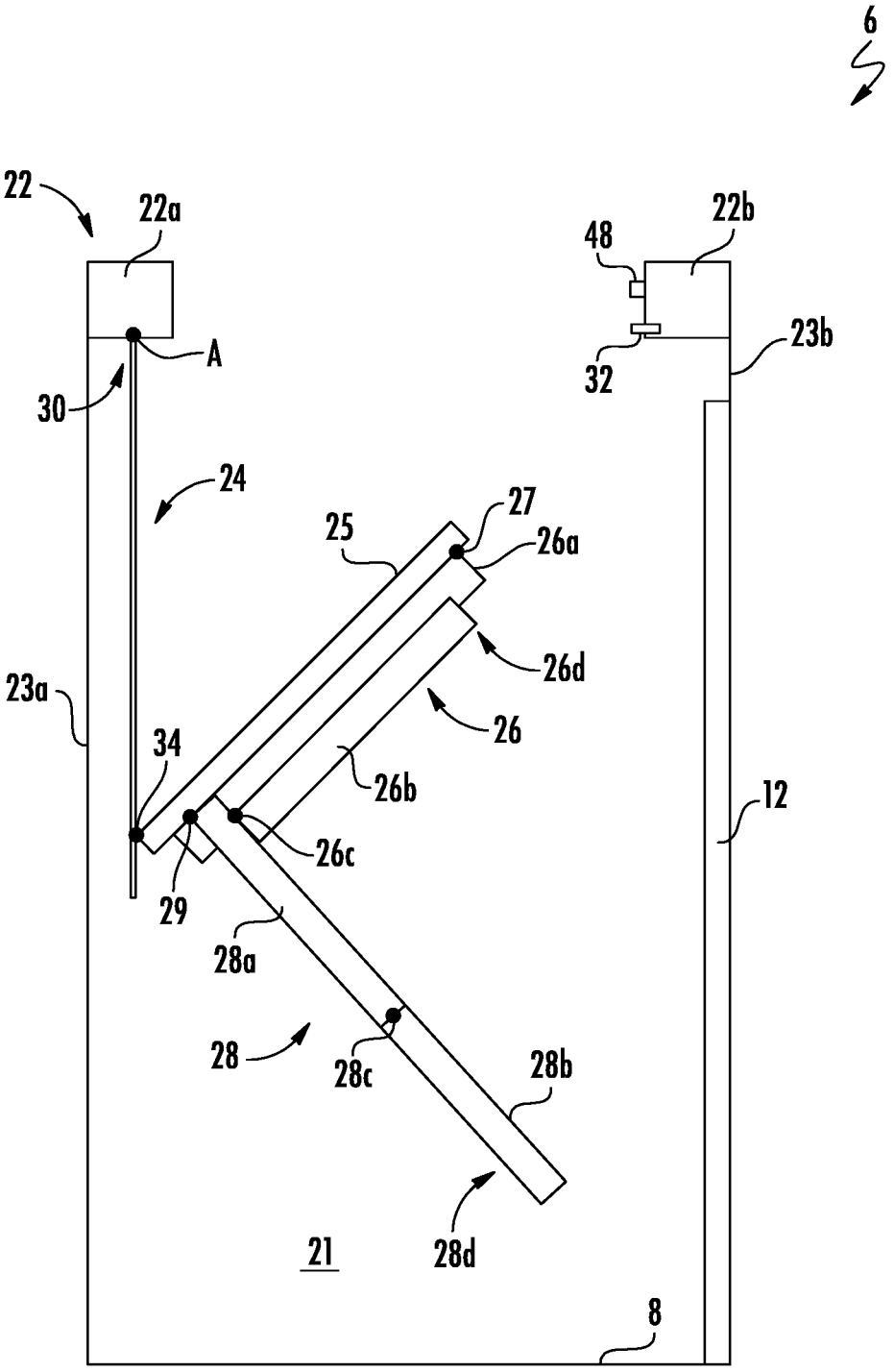
Figure 9:
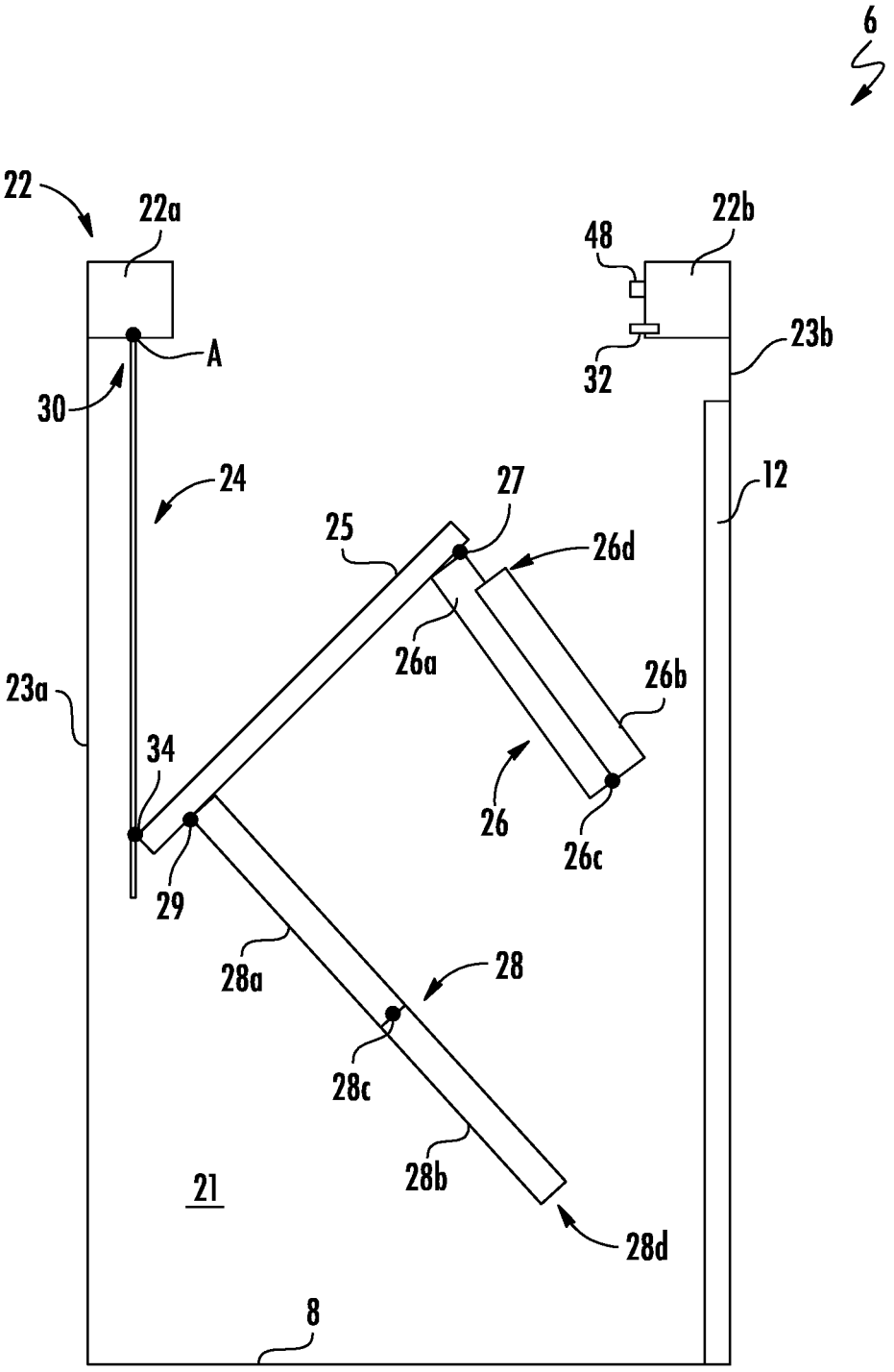
Figure 10:
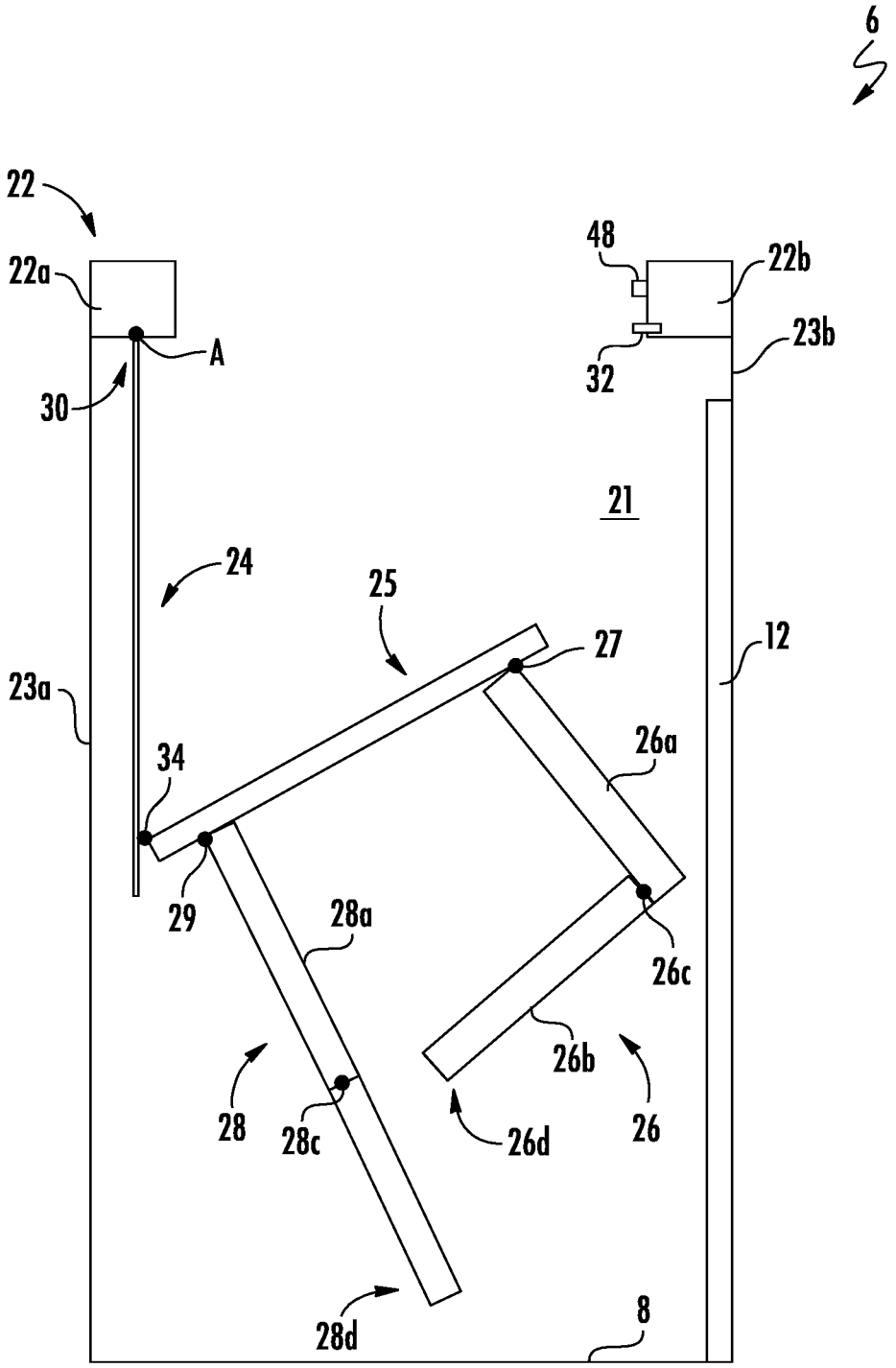
Figure 11:
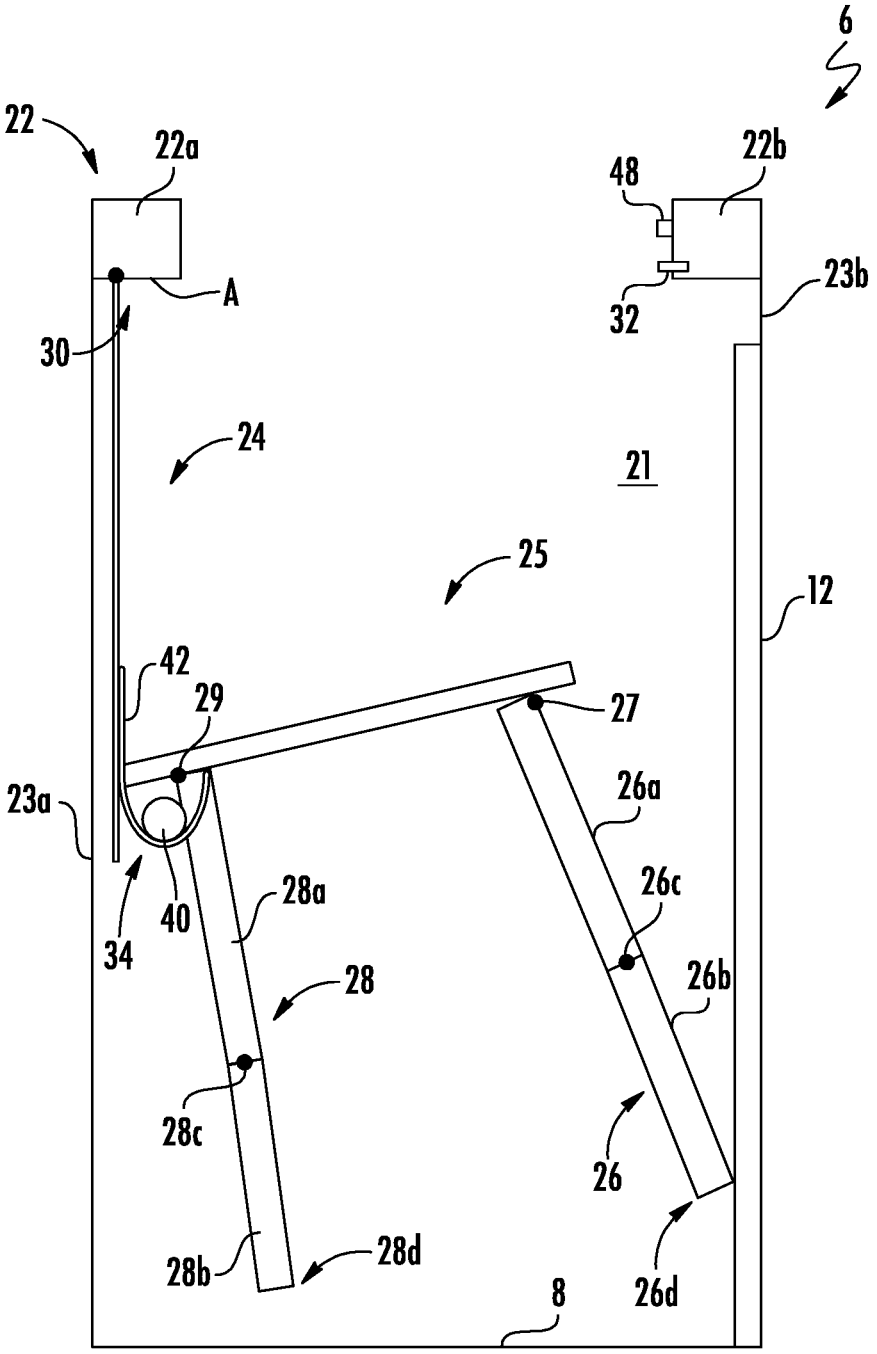

Simultaneously, or after the at least one foldable leg 26, 28 has been at least partially extended, the working platform 25 is pivoted from its storage position, in which the working platform 25 extends basically parallel to the movable ceiling 24 (see FIGS. 2 to 5), towards a working position, in which the working platform 25 extends at an angle from the movable ceiling 24 (see FIG. 6).

While the working platform 25 is pivoted towards the working position, both foldable legs 26, 28 are fully extended into their respective working configurations (see FIGS. 7 to 11).

Each foldable leg 26, 28 comprises two leg portions 26*a*, 26*b*, 28*a*, 28*b*, which are pivotably linked with each other by an internal leg hinge 26*c*, 28*c*, respectively. The internal leg hinges 26*c*, 28*c* are lockable at least in the storage configuration (see FIGS. 2 to 3) and/or in the fully extended working configuration (see FIGS. 8 to 14) of the foldable legs 26, 28 in order to prevent an undesired folding/unfolding of the foldable legs 26, 28. Optionally, the internal leg hinges 26*c*, 28*c* may be lockable in intermediate configurations, too.

The internal leg hinges 26*c*, 28*c* in particular may include ratchet mechanisms, which allow unfolding the leg portions 26*a*, 26*b*, 28*a*, 28*b* from the storage configuration into the working configuration, but which prevent folding the leg portions 26*a*, 26*b*, 28*a*, 28*b* back into the storage configuration without unlocking the internal leg hinges 26*c*, 28*c*. The internal leg hinges 26*c*, 28*c*, for example, may be unlocked by pressing an unlocking button or lever (not shown) provided at the internal leg hinges 26*c*, 28*c*.

Figure 15:
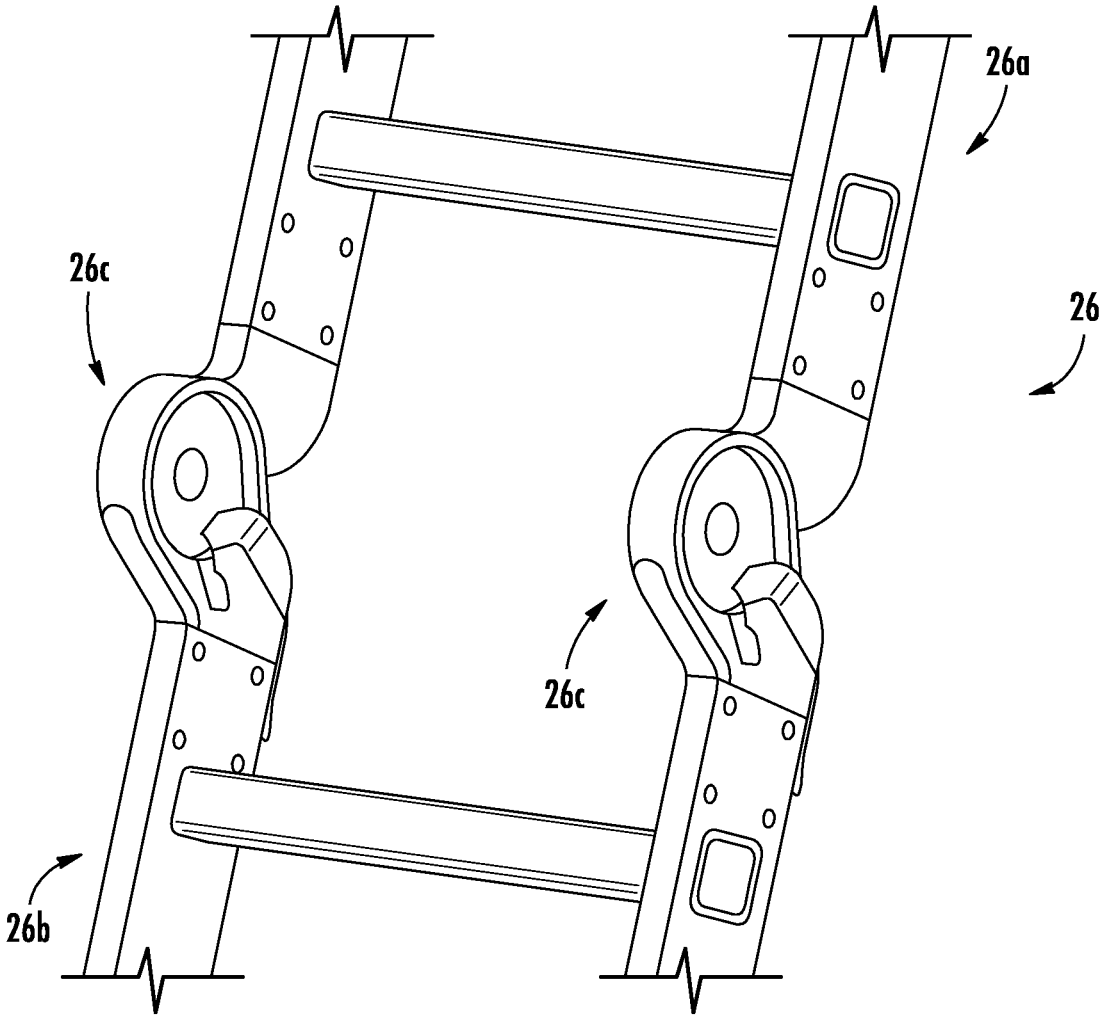
FIG. 15 is an enlarged three-dimensional picture of two internal leg hinges according to an exemplary embodiment of the invention.

An enlarged three-dimensional picture of an exemplary configuration of two internal leg hinges 26*c* is shown in FIG. 15.

Figure 12:
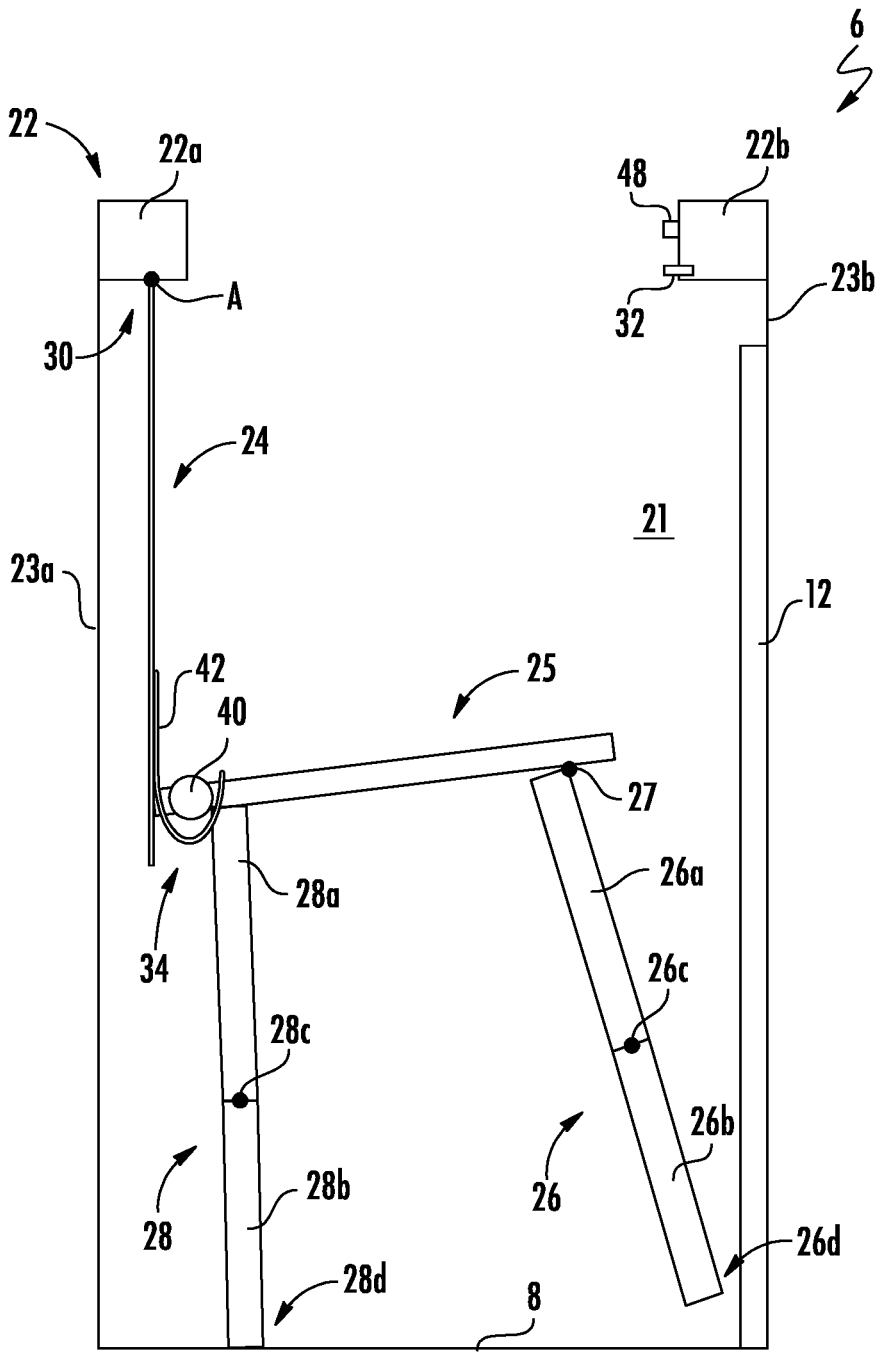
Figure 13:
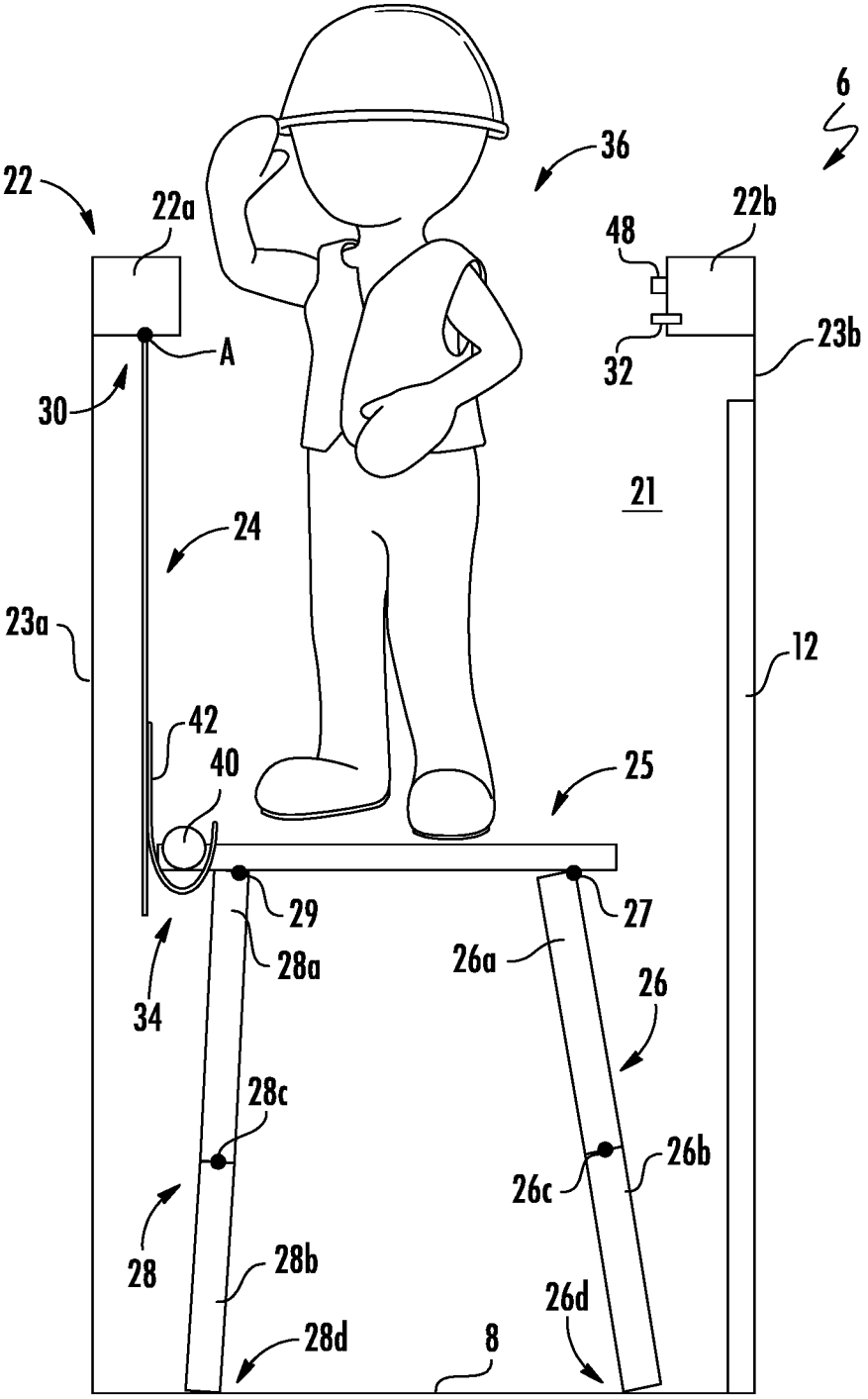

After both foldable legs 26, 28 have been fully extended into their working positions (see FIG. 11) the working platform 25 is moved into its working position (see FIGS. 12 and 13). When arranged in the working position, the working platform 25 extends substantially orthogonally from the substantially vertically extending movable ceiling 24 basically parallel to the car floor 20, as it is shown in FIG. 13. When the working platform 25 is arranged in the working position, lower ends 26*d*, 28*d* of the foldable legs 26, 28 contact the car floor 20 of the elevator car 6 supporting the working platform 25 on the car floor 20. After the working platform 25 has been arranged in the working position with the foldable legs 26, 28 supporting the working platform 25 on the car floor 20 of the elevator car 6, a mechanic 36 may climb onto the working platform 25 for performing maintenance and/or repair on top of or above the elevator car 6 (see FIG. 13).

In order to make it easier, safer and more convenient for mechanics 36 to climb onto the working platform 25, at least one of the foldable legs 26, 28 may comprise at least one step 38, in particular a plurality of steps 38 forming a ladder extending between the car floor 20 and the working platform 25. The at least one step 38 in particular may be formed at a "front leg" 26, which is mounted closer to the end of the working platform 25 facing towards the elevator car door 12 than the other ("rear") leg 28, when the working platform 25 is arranged in the working position.

Figure 14:
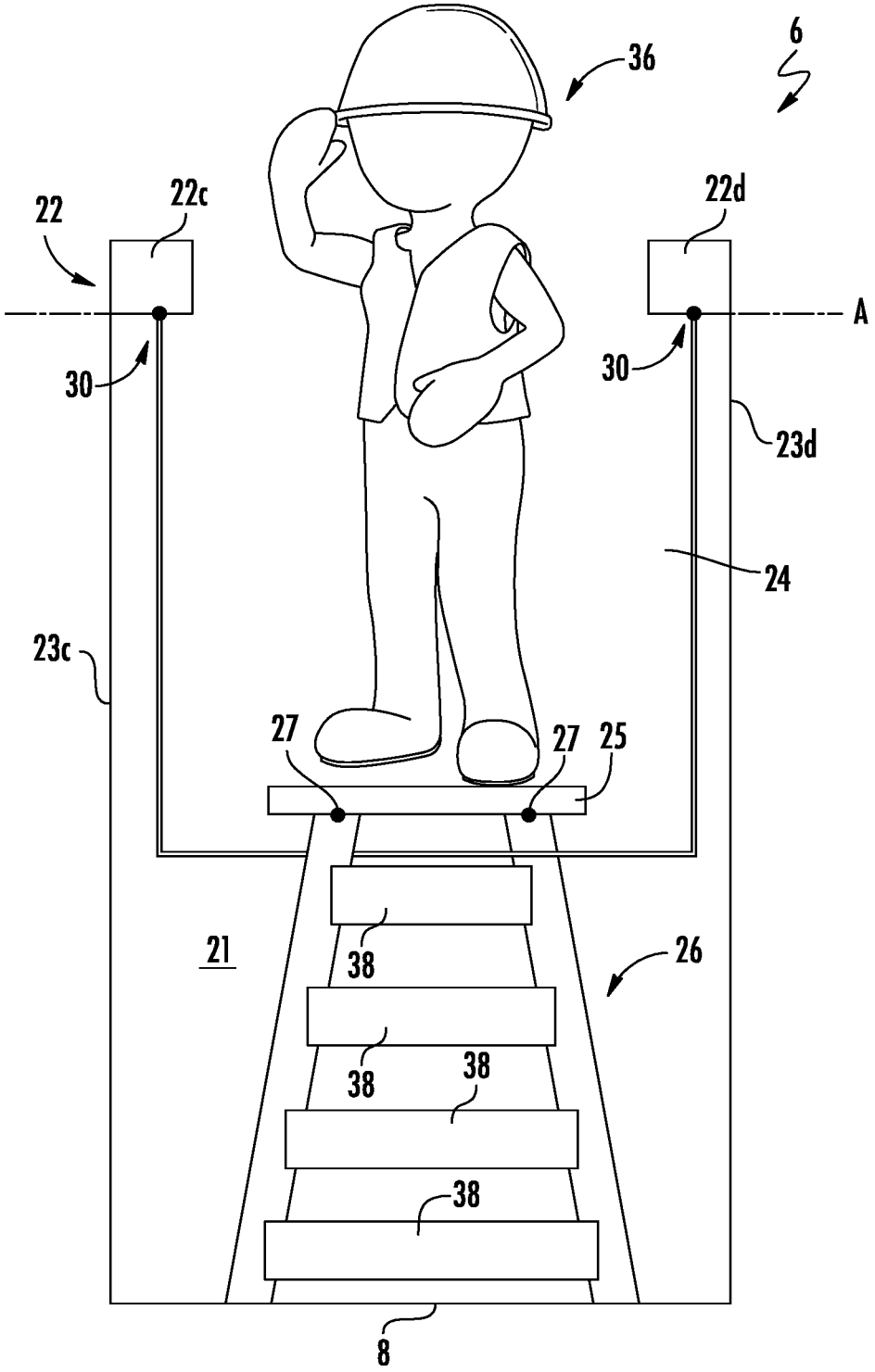
FIG. 14 depicts a schematic cross-sectional front view of an elevator car according to an exemplary embodiment of the invention with the working platform arranged in the working position.

Such a configuration is illustrated in FIG. 14 showing a front view, i.e. a view through the elevator car door 12 (not shown in FIG. 14), of the elevator car 6 with the working platform 25 being arranged in its working position.

In order to allow positioning the lower ends 26*d*, 28*d* of the foldable legs 26, 28 on the car floor 20 of the elevator car 6 when the working platform 25 is pivoted around a horizontally extending axis (cf. FIGS. 11 to 13), the mechanical link 34 linking the working platform 25 with the movable ceiling 24 is configured not only for allowing the previously described pivoting motion of working platform 25 with respect to the movable ceiling 24, but it further allows the working platform 25 to move linearly along the length of movable ceiling 24, i.e. in a substantially vertical direction, when the movable ceiling 24 is arranged substantially vertically in its maintenance position.

A schematic view of a mechanical link 34 according to an exemplary embodiment of the invention is depicted in FIGS. 11 to 13, 16 and 17.

The mechanical link 34 comprises a support bar 40, which is attached to or formed integrally with the working platform 25, and a curved, in particular concave, support surface 42 supporting the support bar 40. The support surface 42 is attached to or formed integrally with the movable ceiling 24.

Figure 16:
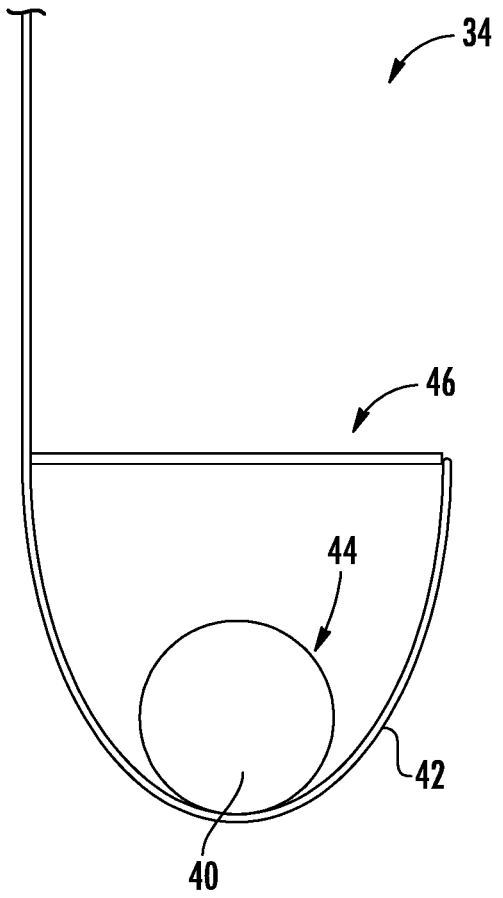
FIGS. 16 and 17 depict schematic enlarged views of a mechanical link according to an exemplary embodiment of the invention.
Figure 17:
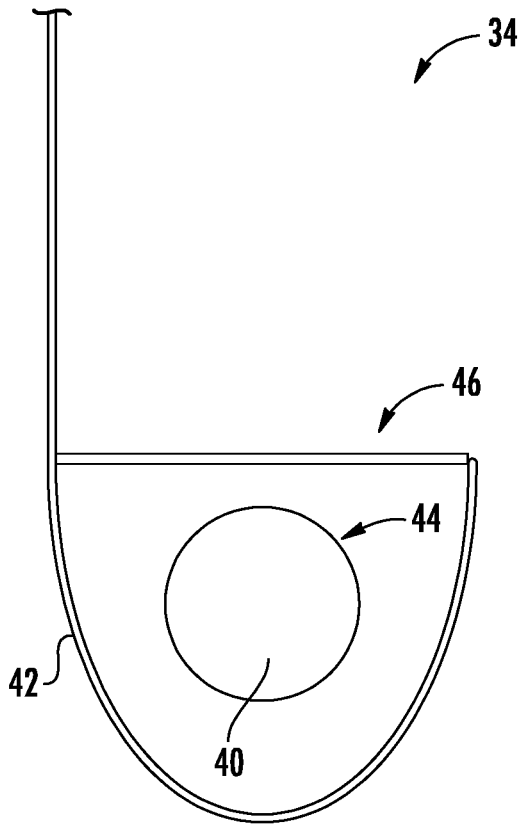

As shown in FIGS. 16 and 17, the support bar 40 has a round cross-section resulting in a round outer peripheral surface 44 of the support bar 40. The round outer peripheral surface 44 allows the support bar 40 to rotate with respect to the support surface 42. This allows the working platform 25 to pivot with respect to the movable ceiling 24.

The support bar 40 is not fixed to the support surface 42. Instead, the support bar 40 may be lifted of the support surface 42 (see FIG. 17). This allows the working platform 25 to move linearly, in particular vertically, with respect to the movable ceiling 24.

In consequence, as soon as the lower end 26*d*, 28*d* of at least one of the foldable legs 26, 28 reaches the car floor 20 of the elevator car 6 (cf. FIG. 12), the working platform 25 is lifted by lifting the support bar 40 from the support surface 42 in order to allow placing the lower ends 26*d*, 28*d* of both foldable legs 26, 28 firmly onto the car floor 20 (cf. FIGS. 12 and 13).

As a result, the support bar 40 does not contact the support surface 42 but is lifted from the support surface 42 when the working platform 25 is in its final working position, in which the foldable legs 26, 28 are supported on the car floor 20 of the elevator car 6 (see FIG. 13). Thus, the weight of the working platform 25 and a mechanic 36 standing on the working platform 25 is not loaded on the movable ceiling 24. In consequence, the movable ceiling 24, the ceiling hinge 30 and the mechanical link 34 need to be designed only for supporting the weight of the working platform 25 and the foldable legs 26, 28, but not for supporting the additional weight of the mechanic 36.

For preventing the working platform 25 from being completely separated from the movable ceiling 24, a mechanical barrier 46 may be provided above the support surface 42. The mechanical barrier 46 limits the maximum vertical distance between the support bar 40 and the support surface 42. The mechanical barrier 46 may be removable/detachable in order to allow detaching the working platform 25 from the movable ceiling in exceptional situations.

Optionally, the elevator car 6 may be equipped with at least one sensor 48 (see FIGS. 2 to 14), which is configured for detecting whether the movable ceiling 24, the working platform 25 and/or the foldable legs 26, 28 are arranged in their respective normal operation/storage positions and configurations as depicted in FIG. 1. The sensor 48 may be a mechanical sensor, an optical sensor, a capacitive sensor, or a combination thereof. The sensor 48 may deliver a signal to the elevator controller 9, and the elevator controller 9 may allow the elevator car 6 to move in normal operation only if the sensor 48 confirms that the movable ceiling 24, the working platform 25 and the foldable legs 26, 28 are arranged in their respective normal operation/storage positions and configurations.

If the sensor 48 does not confirm that the working platform 25 and the foldable legs 26, 28 are arranged in their respective normal operation/storage positions and configurations, the elevator controller 9 may prevent any movement of the elevator car 6.

Alternatively to preventing any movement of the elevator car 6, the elevator controller 9 may be configured to allow the elevator car 6 to move in a restricted maintenance mode only if the sensor 48 does not confirm that the working platform 25 and the foldable legs 26, 28 are in their respective normal operation/storage positions and configurations. Moving the elevator car 6 in a restricted maintenance mode allows the mechanic 36 to perform special maintenance tasks which need the elevator car 6 to move while the working platform 25 is arranged in its working configuration. When the elevator car 6 is moved in the restricted maintenance mode, the positions, the speed and/or the acceleration of the elevator car 6 may be restricted compared to a normal mode of operation.

While the invention has been described with reference to exemplary embodiments, it will be understood by those skilled in the art that various changes may be made and equivalents may be substituted for elements thereof without departing from the scope of the invention. In addition, many modifications may be made to adopt a particular situation or material to the teachings of the invention without departing from the essential scope thereof. Therefore, it is intended that the invention shall not be limited to the particular embodiment disclosed, but that the invention includes all embodiments falling within the scope of the dependent claims.

What is claimed is:

1. An elevator car (6) comprising:

a car floor (20);

a movable ceiling (24), which is pivotable between a normal operating position as a ceiling of the elevator car, and a maintenance position, in which the movable ceiling (24) extends into an interior space (21) of the elevator car (6);

a working platform (25) movably attached to the movable ceiling (24), wherein the working platform (25) is pivotable between a storage position and a working position, in which the working platform (25) extends transversely from the movable ceiling (24);

at least one foldable leg (26, 28) attached to the working platform (25), wherein the at least one foldable leg (26, 28) is foldable between a storage configuration and a working configuration, in which the at least one foldable leg (26, 28) extends transversely from the working platform (25) for supporting the working platform (25) on the car floor (20);

at least one mechanical link (34) linking the working platform (25) with the movable ceiling (24) and allowing the working platform (25) to pivot with respect to the movable ceiling (24), wherein the at least one mechanical link (34) allows the working platform (25) to move linearly with respect to the movable ceiling (24).

2. The elevator car (6) according to claim 1, wherein the movable ceiling (24), when arranged in the maintenance position, extends vertically within the elevator car (6), and/or wherein the working platform (25), when arranged in the working position, extends orthogonally from the movable ceiling (24).

3. The elevator car (6) according to claim 1, wherein the at least one foldable leg (26, 28) comprises at least two leg portions (26*a*, 26*b*, 28*a*, 28*b*) pivotably linked with each other.

4. The elevator car (6) according to claim 1, wherein the at least one foldable leg (26, 28) is lockable in at least one of the storage configuration and the working configuration; and/or wherein the movable ceiling (24) is lockable in at least one of the normal operating position and the maintenance position.

5. The elevator car (6) according to claim 1, wherein the at least one foldable leg (26, 28) comprises at least one step (38).

6. The elevator car (6) according to claim 1, comprising at least two foldable legs (26, 28).

7. The elevator car (6) according to claim 6, wherein the at least two foldable legs (26, 28) are mounted towards opposing ends of the working platform (25).

8. The elevator car (6) according to claim 7 further comprising an elevator car door (12), wherein at least one of the two foldable legs (26, 28), which is mounted towards an end of the working platform (25) facing the elevator car door (12), comprises at least one step (38).

9. The elevator car (6) according to claim 1, wherein the at least one mechanical link (34) comprises a support bar (40) attached to and/or formed integrally with the working platform (25), and at least one concave support surface (42) attached to and/or formed integrally with the movable ceiling (24) and supporting the support bar (40).

10. The elevator car (6) according to claim 9, wherein the support bar (40) has a round cross-section.

11. The elevator car (6) according to claim 1, wherein the at least one mechanical link (34) further comprises a mechanical barrier (46) preventing the working platform (25) from being separated from the movable ceiling (24).

12. The elevator car (6) according to claim 1, further comprising at least one sensor (48) configured for detecting whether the movable ceiling (24) is arranged in its normal operating position.

13. The elevator system (2) comprising an elevator car (6) according to claim 1, wherein the elevator system (2) further comprises an elevator controller (9) which is configured for preventing any movement of the elevator car (6) if the sensor (48) does not indicate that the movable ceiling (24) is arranged in its normal operating position.

14. A method of deploying the working platform (25) of an elevator car (6) according to claim 1, wherein the method includes:

unlocking the movable ceiling (24);

moving the movable ceiling (24) from its normal operating position into its maintenance position;

moving the working platform (25) from its storage position into its working position;

extending the at least one foldable leg (26, 28) from its storage configuration into its working configuration before, while and/or after the working platform (25) is moved;

locking the at least one foldable leg (26, 28) in its working configuration; and supporting the at least one foldable leg (26, 28) on the car floor (20) of the elevator car (6).

* * * * *